US006997333B2

(12) United States Patent
Howard

(10) Patent No.: US 6,997,333 B2
(45) Date of Patent: Feb. 14, 2006

(54) KEY RACK

(76) Inventor: Raymond W. Howard, 7890 Dunbrook Rd., San Diego, CA (US) 92126-4369

( * ) Notice: Subject to any disclaimer, the term of this patent is extended or adjusted under 35 U.S.C. 154(b) by 7 days.

(21) Appl. No.: 10/607,635

(22) Filed: Jun. 27, 2003

(65) Prior Publication Data

US 2004/0262248 A1 Dec. 30, 2004

(51) Int. Cl.
*A47F 7/00* (2006.01)

(52) U.S. Cl. ..... 211/85.9

(58) Field of Classification Search ..... 211/85.9, 211/87.01; 40/299.01, 330, 634, 657
See application file for complete search history.

(56) References Cited

U.S. PATENT DOCUMENTS 2,159,322 A * 5/1939 Drummond ..... 40/657
2,889,050 A * 6/1959 Modrey ..... 211/4
D259,453 S * 6/1981 Warhaftig ..... D6/563
4,326,761 A * 4/1982 Schwartz ..... 312/326
D269,656 S * 7/1983 Swett et al. ..... D6/567
4,410,095 A * 10/1983 Dembicks ..... 211/70.6
4,546,888 A * 10/1985 Rosberg et al. ..... 211/106.01
5,669,515 A * 9/1997 Tisbo et al. ..... 211/70.6
D444,377 S * 7/2001 Harvey ..... D8/371
D458,070 S * 6/2002 Bennett et al. ..... D6/567
D468,949 S * 1/2003 Howard ..... D6/569

* cited by examiner

*Primary Examiner*—Hugh B. Thompson, II
(74) *Attorney, Agent, or Firm*—John J. Murphey

(57) ABSTRACT

A key rack with a unique stacking system is provided. The key rack has grooves and/or curves provided thereon such that the grooves and or curves of one key rack fit into the grooves and/or curves provided on another rack thereby allowing one rack to combine with a second rack to form a larger key rack system. The key rack has a tier system of hooks that allow for one tier of hooks to be horizontally and vertically offset from a second tier of hooks.

14 Claims, 3 Drawing Sheets

KEY RACK

FIELD OF THE INVENTION

This invention relates to the field of key racks. More specifically, this invention relates to a curvy and/or grooved key rack that may be used to store keys. Further, this invention relates to curvy, key racks that may be stacked and/or placed together to form a larger key rack.

BACKGROUND OF THE INVENTION

In today's society, many people carry many keys with them. For example, many people care their house keys, car keys, office keys and a variety of other different keys. Further, many organizations carry a lot of keys that have to be kept separate. For example, a car dealership may have several keys to different cars on the lot. Similarly, a car rental agency may have many keys to several different cars that are located on their lot. An individual may also carry many outdated keys that have no function anymore. The individual may carry keys to the homes of close relatives, old residences, bikes and other products. Many times, these individuals do not even know what the specific key will open. Often, separate keys are stored in separate locations and they can be lost or forgotten. Further if a key rack is provided, many times the key rack configuration is not conducive to easy identification and retrieval of a particular key or key chain.

Many people keep their keys on a key rack for safekeeping and for easy identification and location of the keys. Most people keep a variety of different keys on their key rack at any given time. For example, a car dealership may keep a key rack having a plurality of hooks to store the keys for the cars on their lot. Commonly, the keys are labeled to identify the car for which it belongs. Further, an individual may have a key rack in their home to store and locate where they leave their keys.

It has been known in the art to keep keys on a key rack that have hooks to store the key rings or individual keys. Prior art key racks are typically made of a single fixed piece which may hold a key hook or hooks for placement of the key rings or keys. Many of the prior art key racks are stand-alone units, and are affixed to a wall for easy location and retrieval of the keys. The problem with these prior art key rings is that they cannot be expanded to hold more keys and/or key rings once the hooks are all in use. When the available key hooks are used, an individual must find another place to store the key rings and/or keys when they are not in use. Further, the existing key racks do not allow for a key rack to be stacked together using a unique design that allows a plurality of key racks to be combined using a unique design such that the key racks combine to make a larger key rack in different configurations. Consequently, when the prior art rack is used, a new key rack must be acquired, or the keys must be stored in another location.

What is needed is a key rack that has a unique design such that the key rack may store a plurality of keys, and further wherein the key rack may be coupled with a plurality of similar key racks to store additional keys and/or key rings when necessary. Further, a key rack is needed that may be temporarily placed at a location when needed to facilitate the location and storage of key rings and/or keys. Additionally, a key rack is needed that may be permanently placed when needed to facilitate the location and/or storage of key rings and/or keys.

SUMMARY OF THE INVENTION

The present invention provides a key rack with a unique stacking system. More specifically, the present invention provides a key rack having grooves and/or curves provided thereon such that the grooves and/or curves of one key rack fit into the grooves provided on another rack thereby allowing one rack to combine with a second rack to form a larger key rack system. Further, the present invention provides a key rack having a unique tier configuration where the tiers permit a plurality of hooks to be vertically and horizontally offset from each other.

To this end, in an embodiment of the present invention, an apparatus for hanging keys is provided. The apparatus has a key rack having a first side and a second side. The first side and the second side are parallel to each other. The apparatus has a key rack having a third side and a fourth side. The first side and the second side connect to the third side and the fourth side of the key rack. Further the apparatus has a front side and a back side wherein the back side is generally flat for attachment to a surface. The front side may have a plurality of curves on the third side and the fourth side. The apparatus also has a plurality of hooks formed on the front side of the key rack.

In an embodiment, the apparatus has a key rack that is composed of plastic.

In an embodiment, the apparatus has a key rack that has a plurality of openings formed thereon between the front side and the back side.

In an embodiment, that apparatus has a third side and a fourth side wherein the third side and the fourth side of the key rack have both a concave surface and a convex surface.

In an embodiment, the apparatus has a back side has adhesive pads for affixing the key rack to a flat surface.

In an embodiment, the apparatus has hooks that are formed into a first tier and a second tier wherein the first tier is in a higher vertical plane than the second tier.

In an embodiment, the apparatus has a plurality of hooks extending out from the front of the key rack.

In an embodiment of the present invention a key rack system is provided. The system has a key rack having a first side and a second side wherein the first side and the second side are on the same plane. The apparatus also has a key rack having a third side and a fourth side wherein the first side and the second side connect to the third side and the fourth side and further wherein the third side and the fourth side are curvaceous. The apparatus has at least one hook being associated with the key rack.

In an embodiment, the system has a second key rack having a first side and a second side. The second key rack also has a third side and a fourth side wherein the third side and the fourth side are curvaceous.

In an embodiment, the system has a second key rack having a third side and a fourth side which are adaptable to fit into the curves on the third side and the fourth side of the first key rack.

In an embodiment, the system has a plurality of hooks wherein the hooks are configured on a plurality of vertical tiers.

In an embodiment, the system has a plurality of hooks having a plurality of vertical tiers wherein the first tier of hooks is horizontally offset from the second tier of hooks and further wherein the first tier and the second tier of hooks project away from the key rack.

In an embodiment, the system has a plurality of spaced openings on the key rack.

In an embodiment of the present invention, a method for using the key rack is provided. The method has the steps of: providing a key rack having a first side and a second side wherein the first side and the second side are parallel; providing a key rack having a third side and a fourth side wherein the third side and the fourth side are curvaceous and further wherein the first side and the second side connect to the third side and the fourth side; and providing at least one hook for receipt of an article.

In an embodiment, the method comprises the step of providing a second key rack having a first side, a second side, a third side and a fourth side wherein the first side and the second side are parallel to each other and further wherein the third side and the fourth side are curvaceous.

In an embodiment, the method comprises the step of connecting the curvaceous third side and/or the curvaceous fourth side of the second key rack into the corresponding curvaceous counterpart of the third side and/or the fourth side of the first key rack.

In an embodiment, the method comprises the step of combining a plurality of key racks.

In an embodiment, the method comprises the step of affixing the key rack to a flat surface.

In an embodiment, the method comprises the step of placing an object onto the hook of the key rack.

It is, therefore, an advantage of the present invention to provide an apparatus for storing keys and a method for using the same.

Another advantage of the present invention is to provide an apparatus and a method for using the same wherein the key rack may be composed of plastic Another advantage of the present invention is to provide an apparatus and a method for using the same wherein the key rack may be made of wood, metal, or other suitable material.

Still another advantage of the present invention is to provide an apparatus and a method for using the same wherein the key rack has a plurality of hooks for hanging keys.

Yet another advantage of the present invention is to provide an apparatus and a method or using the same wherein a key rack is provided that may have a plurality of hooks for hanging key chains.

Another advantage of the present invention is to provide an apparatus and a method for using the same wherein the key rack may have four sides.

Yet another advantage of the present invention is to provide an apparatus and a method for using the same wherein the key rack may have a plurality of openings between the front and the back of the key rack.

Still another advantage of the present invention is to provide an apparatus and a method for using the same wherein the key rack has two sides that may have curvaceous characteristics.

An advantage of the present invention is to provide an apparatus and a method for using the same wherein a key rack may have a plurality of widths between the front of the apparatus and the back of the apparatus.

Another advantage of the present invention is to provide an apparatus and a method for using the same wherein the key rack may have a plurality of hooks that extend away from the key rack.

Yet another advantage of the present invention is to provide an apparatus and a method for using the same wherein the hooks of the key rack may extend away from the key rack at different angles.

Still another advantage of the present invention is to provide an apparatus and a method for using the same wherein the hooks of the key rack may extend away from the key rack at different distances from the key rack.

Another advantage of the present invention is to provide an apparatus for and a method for using the same wherein a plurality of key racks may be fitted together to form a larger key rack.

Still another advantage of the present invention is to provide an apparatus and system and a method for using the same wherein the curvaceous side of one key rack may fit into the curvaceous side of another key rack.

Another advantage of the present invention is to provide an apparatus and a method for using the same wherein a key rack may be affixed to a flat surface by an adhesive.

Still another advantage of the present invention is to provide an apparatus and a method for using the same wherein the key rack may be affixed to a flat surface by an attachment means.

Another advantage of the present invention is to provide an apparatus and a method for using the same wherein the key rack may hold a plurality of keys and/or key rings.

These and other objects of the invention will become more clear when one reads the following specification, taken together with the drawings that are attached hereto. The scope of protection sought by the inventors may be gleaned from a fair reading of the claims that conclude this specification.

Additional features and advantages of the present invention are described in, and will be apparent form, the detailed description of the presently preferred embodiments and from the drawings.

DESCRIPTION OF THE PREFERRED EMBODIMENT

Figure 1:
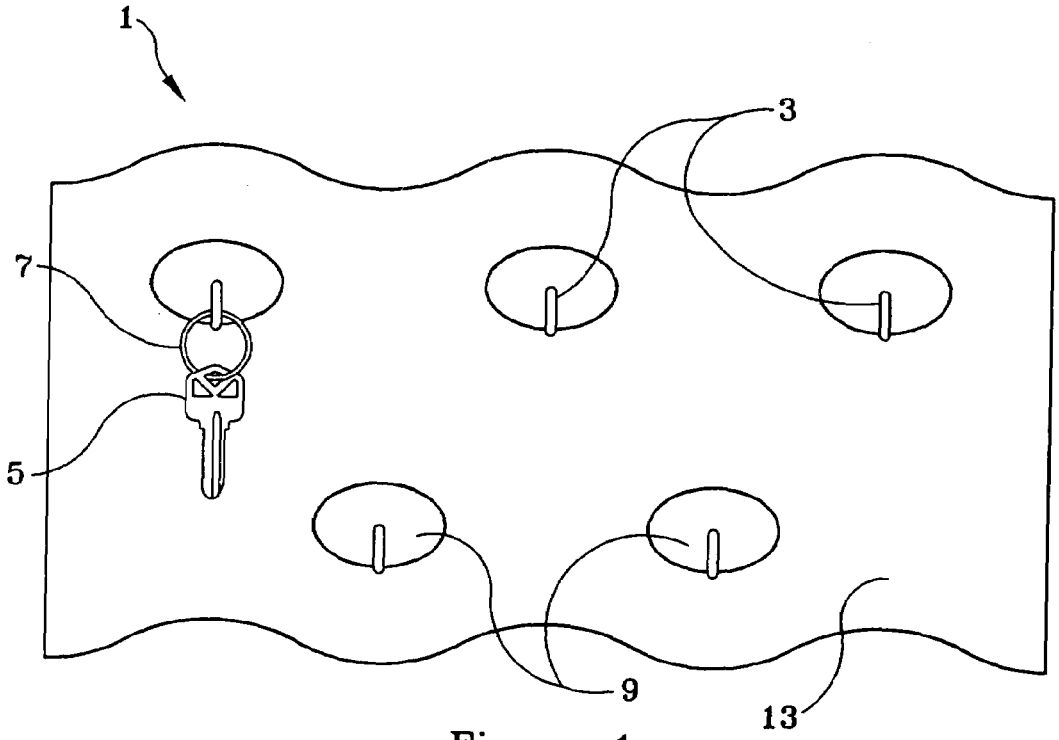
FIG. 1 is a front view of the key rack in an embodiment of the present invention.
Figure 2:
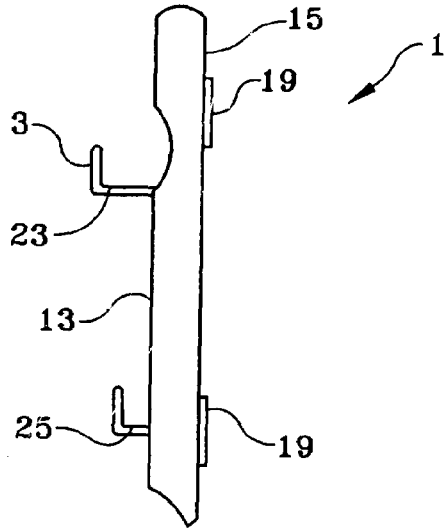
FIG. 2 is a side view of the key rack in an embodiment of the present invention.
Figure 3:
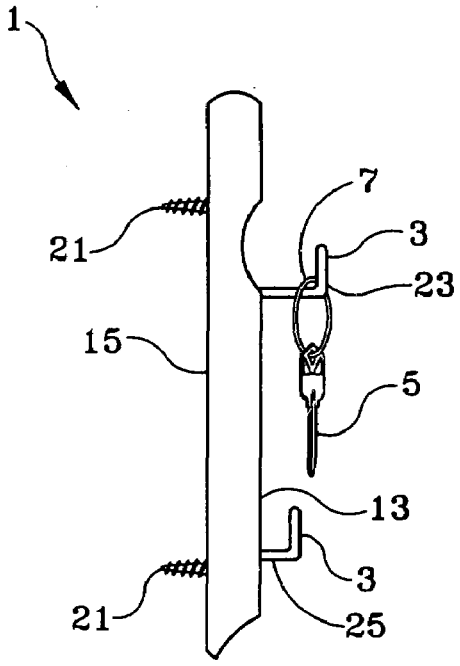
FIG. 3 is another side view of the key rack in an embodiment of the present invention.

Turning now to the drawings wherein elements are identified by numbers and like elements are identified by like numbers throughout the six figures, the invention is depicted in FIG. 1 that shows a key rack. As shown in FIG. 1, the key rack 1 may have four sides to form a rectangular shape. The key rack 1 may have hooks 3 that may be used to store and/or locate a key 5 and/or a key ring 7. In an embodiment of the present invention, the key rack 1 may have a plurality of hooks 3 to store and/or locate a plurality of keys 5 and/or key rings 7. The key rack 1 may also have a plurality of spaced openings 9 between the front side of the rack 13 and the back side of the rack 15. The plurality of hooks 3 may curve up extend away from the key rack 1. In a preferred embodiment of the present invention, the plurality of hooks 3 may be attached to and extend away from the key rack 1 at the spaced openings 9. In this way, a key ring 7 or key may intrude into the spaced openings 9 as illustrated in FIGS. 2 and 3. FIGS. 2 and 3 also illustrate the key rack 1 that may have a front side 13 and a back side 15. The back side 15 may be generally flat such that the back side 15 may be placed against a flat surface which may be a wall (not shown). The back side 15 of the key rack 1 may also be attached to any generally flat surface (not shown). Further, the back side 15 of the key rack 1 may be attached to a flat surface, such as, for example, a wall (not shown) by an adhesive 19 as illustrated in FIG. 2. Alternatively, the back side of the key rack 1 may be attached to a flat surface (not shown) by use of screws 21 as illustrated in FIG. 3. The plurality of hooks 3 may be placed in a tier and/or row configuration on the key rack 1. The first tier of hooks 23 extending away from the key rack 1. The second tier of hooks 25 may also extend away from the key rack 1. The first tier of hooks 23 may extend out from the key rack 1 at a distance greater from than the distance the second tier of hooks 25 extend as illustrated in FIGS. 2 and 3. The plurality of hooks 3 on the first tier of hooks 23 and/or the second tier of hooks 25 may accommodate a key 5 and/or a key ring 7.

Figure 4:
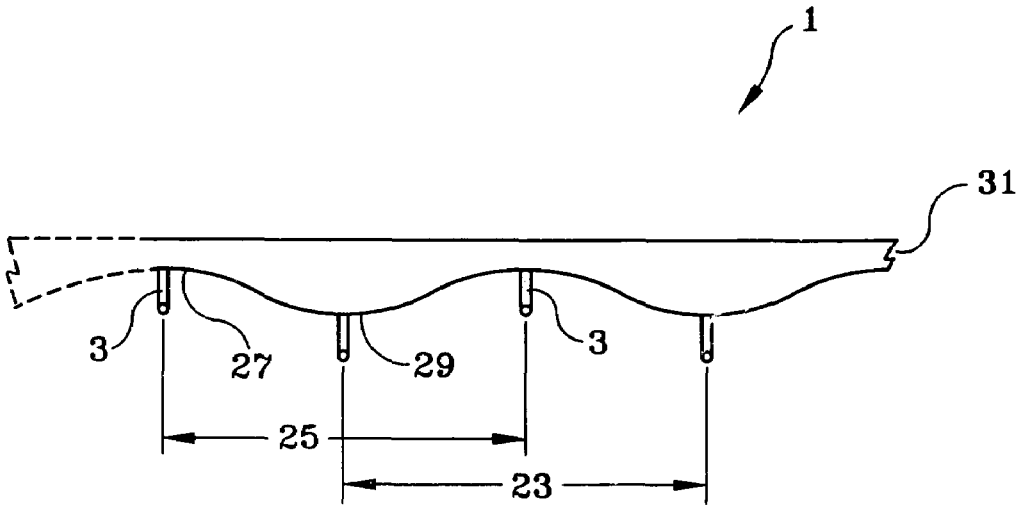
FIG. 4 is a top view of the key rack in an embodiment of the present invention.

FIG. 4 illustrates a top view of the key rack 1 showing the plurality of hooks 3. The key rack 1 may have a concave surface 27 and a convex surface 29 on the front side 13 of the key rack 1. The concave surface 27 and the convex surface 29 may alternate between a first end 31 of the key rack 1 and a second end (not shown) of the key rack 1. FIG. 4 illustrates the key rack 1 that may have a plurality of hooks 3 that may be separated into the first tier of hooks 23 and the second tier of hooks 25. As illustrated in FIG. 4, the first tier of hooks 23 and the second tier of hooks 25 may be horizontally situated in a manner that may allow for the first tier of hooks 23 to be horizontally offset from the second tier of hooks 25.

Figure 5:
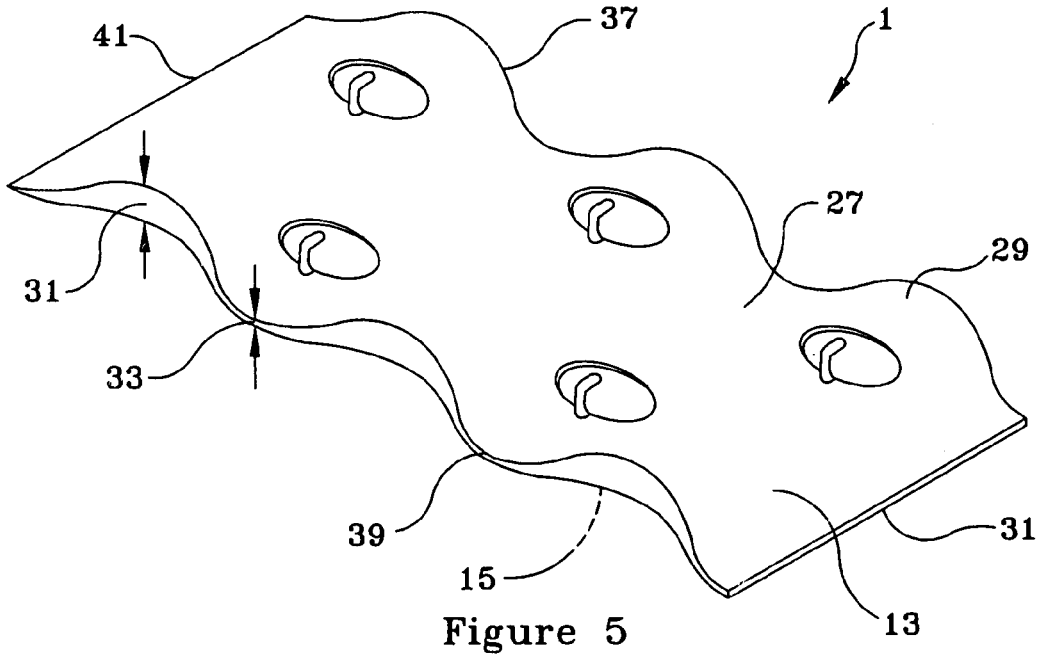
FIG. 5 is a perspective view of the key rack in an embodiment of the present invention.

FIG. 5 illustrates a perspective view of the key rack 1. The key rack 1 may have a front side 13 and a back side 15 where the front side 13 may have a concave surface 27 and a convex surface 29. The back side 15 of the key rack may be generally flat for placement on a flat surface (not shown) The key rack may have a large width 31 when the key rack 1 surface is convex 29, and may have a small width 33 when the key rack 1 surface is concave 27.

Figure 6:
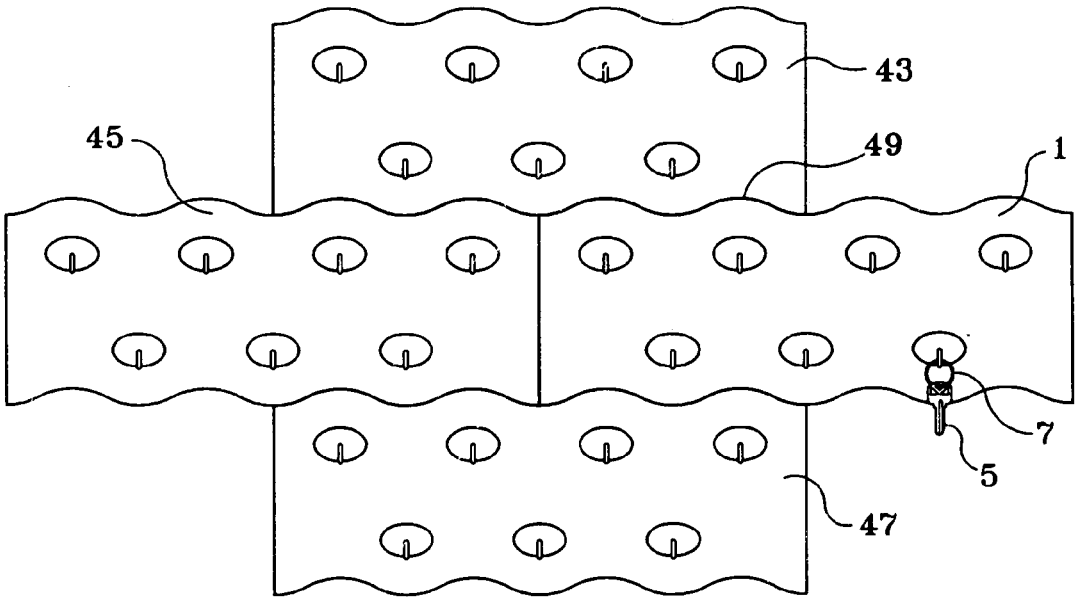
FIG. 6 is a front view of the key rack in combination with a plurality of other key racks in an embodiment of the present invention.

FIG. 5 also illustrates the key rack 1 that may have a top side 37 and a bottom side 39 that may have a plurality of curves formed thereon. The curves may extend from a first end 31 of the key rack to a second end of the key rack 41. The curves may alternate between convex portions of the key rack 1 and concave portions of the key rack 1. FIG. 6 illustrates another embodiment of the present invention showing a first key rack 1 connected with a second key rack 43, a third key rack 45 and a fourth key rack 47. In the preferred embodiment, the curves on the top side 37 of the first key rack 1 may accommodate the curves from the bottom side 49 of the second key rack 43. The curves of the first key rack may associate and may be removably attached to the curves of any subsequent key rack to form a larger key rack. In this manner, any number of key racks may be associated together to form a larger key rack having the same ornamental design and function of the first key rack 1.

It should be understood that various changes and modifications to the presently preferred embodiments described herein will be apparent to those skilled in the art. Such changes and modifications may be made without departing from the spirit and scope of the present invention and without diminishing its attendant advantages.

What is claimed is:

1. An apparatus for hanging keys, the apparatus comprising:

a key rack having a first side and a second side wherein the first side and the second side are parallel to each other;

the key rack having a third side and a fourth side wherein the first side and the second side connect to the third side and the fourth side;

a front side and a back side wherein the back side is generally flat for attachment to a surface and further wherein the front side has a plurality of curves from the first side to the second side;

a plurality of hooks formed on the front side of the key rack; and a first tier of hooks wherein said first tier of hooks is horizontally offset from a second tier of hooks and further wherein the first tier of hooks and the second tier of hooks projects away the key rack.

2. The apparatus of claim 1 wherein the key rack is composed of plastic.

3. The apparatus of claim 1 wherein the key rack has a plurality of openings formed thereon.

4. The apparatus of claim 1 wherein the third side and the fourth side of the key rack have both a concave surface and a convex surface.

5. The apparatus of claim 1 wherein the backside has adhesive pads for affixing the key rack to a flat surface.

6. The apparatus of claim 1 wherein the key rack may be screwed into a flat surface.

7. The apparatus of claim 1 wherein the hooks are formed into a first tier and a second tier wherein the first tier is in a higher vertical plane than the second tier.

8. The apparatus of claim 1 wherein the plurality of hooks extend out from the key rack.

9. A method for using the curvy key rack, the method comprising the steps of:

providing a key rack having a first side and a second side wherein the first side and the second side are parallel;

providing a key rack having a third side and a fourth side wherein the third side and the fourth side are convex and concave and further wherein the first side and the second side connect to the third side and the fourth side; and providing a first tier of hooks for receipt of an article that is horizontally offset from the second tier of hooks for receipt of an article and further wherein the first tier and the second tier of hooks projects away from the key reack.

10. The method of claim 9, further comprising the step of:

providing a second key rack having a first side, a second side, a third side and a fourth side wherein the first side and the second side are parallel to each other and further wherein the third side and the fourth side are convex and concave.

11. The method of claim 10, further comprising the step of:

connecting the convex third side and or the concave fourth side of the second key rack into the corresponding concave third side and or the convex fourth side of the first key rack.

12. The method of claim 9, further comprising the step of:

combining a plurality of key racks.

13. The method of claim 9, further comprising the step of:

affixing the key rack to a flat surface.

14. The method of claim 9 further comprising the step of:

a placing a key or a key ring onto the hook of the key rack.

* * * * *